US008322354B2

(12) United States Patent
Parker

(10) Patent No.: US 8,322,354 B2
(45) Date of Patent: Dec. 4, 2012

(54) MAKE-UP KIT

(75) Inventor: Philippe Parker, Zetjun (MT)

(73) Assignee: Toly Products (U.K.) Ltd. (GB)

( * ) Notice: Subject to any disclaimer, the term of this patent is extended or adjusted under 35 U.S.C. 154(b) by 39 days.

(21) Appl. No.: 12/796,685

(22) Filed: Jun. 9, 2010

(65) Prior Publication Data

US 2010/0319723 A1 Dec. 23, 2010

(30) Foreign Application Priority Data

Jun. 22, 2009 (GB) ..... 0910732.7

(51) Int. Cl.
*A45D 33/20* (2006.01)
*A45D 40/24* (2006.01)

(52) U.S. Cl. ..... 132/287; 206/501; 206/503; 206/509; 132/294; 132/295

(58) Field of Classification Search ..... 132/286, 132/287, 294, 295, 300, 314, 315, 317, 293; 206/501, 503, 507, 509, 511; 220/4.27; *A45D 33/20, 40/24*
See application file for complete search history.

(56) References Cited

U.S. PATENT DOCUMENTS 3,133,771 A * 5/1964 Dorman ..... 312/107
3,194,426 A * 7/1965 Brown, Jr. ..... 220/23.4
3,287,075 A * 11/1966 Batke et al. ..... 312/108
4,165,815 A * 8/1979 Vetter ..... 220/4.27
4,728,159 A * 3/1988 Solomon et al. ..... 312/111
4,743,077 A * 5/1988 Bohnet et al. ..... 312/9.11
4,807,773 A * 2/1989 Tsai ..... 220/4.27
4,889,254 A * 12/1989 Vola ..... 220/23.4
5,381,916 A * 1/1995 Strawder ..... 220/23.4
5,515,239 A * 5/1996 Kamerman et al. ..... 361/727
5,535,908 A * 7/1996 Sheu ..... 220/4.27
5,676,251 A 10/1997 Credle, Jr.
5,699,925 A * 12/1997 Petruzzi ..... 220/4.27
5,890,613 A * 4/1999 Williams ..... 220/23.4

(Continued)

FOREIGN PATENT DOCUMENTS

DE 202007001796 5/2007

(Continued)

OTHER PUBLICATIONS

Combined Search and Examination Report issued in priority Application No. GB0910732.7.

(Continued)

*Primary Examiner* — Robyn Doan
*Assistant Examiner* — Tatiana Nobrega
(74) *Attorney, Agent, or Firm* — Dean W. Russell; Kristin M. Crall; Kilpatrick Townsend & Stockton LLP

(57) ABSTRACT

There is provided a make-up kit having a plurality of containers having top surfaces made up of different integer numbers of substantially identically shaped units and bottom surfaces made up of corresponding numbers of substantially identically shaped units, peripheral areas of the top surface units being of complementary shape to peripheral areas of the bottom surface units, so that each container is separably interengageable with at least one other of the containers above or below, by interengagement of the complementary shaped unit peripheral areas. In this way, large or small numbers of identical or different units may be connected together in a large number of different configurations; each differently shaped container effectively forming a differently shaped, but mutually compatible, building block.

9 Claims, 7 Drawing Sheets

U.S. PATENT DOCUMENTS

| | | | | |
|---|---|---|---|---|
| 6,041,935 | A * | 3/2000 | Yang | 206/581 |
| 6,223,921 | B1 * | 5/2001 | Huang | 220/4.27 |
| 6,378,533 | B1 * | 4/2002 | Roman | 132/295 |
| 6,412,640 | B1 * | 7/2002 | Destanque et al. | 206/581 |
| 6,615,841 | B2 * | 9/2003 | DeLoach | 131/329 |
| 6,681,780 | B1 * | 1/2004 | Baxter | 132/295 |
| 7,621,421 | B2 * | 11/2009 | Ohayon | 220/529 |
| 7,690,856 | B2 * | 4/2010 | Mortensen | 403/326 |
| 7,806,284 | B2 * | 10/2010 | Mangano | 220/4.27 |
| 2003/0057127 | A1 * | 3/2003 | Lambert | 206/581 |
| 2003/0150857 | A1 * | 8/2003 | Tsai | 220/4.27 |
| 2004/0178161 | A1 * | 9/2004 | Galustyan | 215/11.1 |
| 2005/0224384 | A1 * | 10/2005 | Sands et al. | 206/503 |
| 2006/0144743 | A1 * | 7/2006 | McDade | 206/503 |
| 2007/0023429 | A1 | 2/2007 | Konecnik | |
| 2008/0041756 | A1 * | 2/2008 | Tasman | 206/508 |
| 2008/0302790 | A1 * | 12/2008 | Chen | 220/6 |
| 2009/0044827 | A1 * | 2/2009 | Zilber et al. | 132/297 |
| 2009/0126758 | A1 * | 5/2009 | Chen | 132/295 |
| 2009/0145790 | A1 * | 6/2009 | Panosian et al. | 206/373 |
| 2009/0272659 | A1 * | 11/2009 | Kaiser et al. | 206/235 |
| 2010/0025285 | A1 * | 2/2010 | Campbell et al. | 206/581 |
| 2011/0089070 | A1 * | 4/2011 | Resnick | 206/509 |

FOREIGN PATENT DOCUMENTS

| | | |
|---|---|---|
| GB | 1203403 | 8/1970 |
| GB | 2136399 | 9/1984 |
| GB | 2367551 | 4/2002 |
| WO | WO2006084553 | 8/2006 |

OTHER PUBLICATIONS

Office Action dated Mar. 8, 2011 in related European Application No. 10163714.8.

* cited by examiner

MAKE-UP KIT

CROSS REFERENCE TO RELATED APPLICATION

This application claims priority to Great Britain Patent Application No. GB0910732.7 filed with the United Kingdom Patent Office on Jun. 22, 2009, the contents of which are incorporated herein by reference.

RELATED FIELDS

Embodiments of this invention relate to a kit for storing and organizing cosmetic products, make-up application tools and other small personal items, such as personal grooming tools and jewelry, as are commonly found on or around a dressing table.

BACKGROUND

Such kits are known, for storing and organizing cosmetic products such as eye shadow, blusher and face powder, nail varnish, lipsticks, lip gloss, mascara and eyeliner pencils. They may also contain applicator tools such as makeup brushes, puffs and sponges, and personal grooming tools such as mirrors, tweezers, combs and manicure sets. The stored items may be provided as an integral part of the kit, or as "loose" products either supplied with the kit or purchased separately. The kit may therefore include drawers and storage compartments specially adapted to contain products and tools included in the kit as purchased, e.g. godets containing pressed solid cosmetics, such as face powder and the like, or holders of a special shape to removably store tools supplied as part of the kit. Additionally or alternatively the kit as supplied may include empty drawers, storage compartments or similar, for storing makeup, makeup applicator tools and the like, or for storing other small personal items such as jeweler, all acquired separately.

Known storage and organiser kits of this kind generally comprise a main base, tray, cabinet or container, to which are fitted smaller drawers, shelves, racks, bins or similar storage compartments. These are either permanently fixed, or can only be rearranged to a limited extent, typically being confined to the main base, container or the like, or selectively insertable into/removable therefrom. The present invention aims to provide a more flexible or adaptable makeup storage and organiser kit, which can therefore be "personalised" in a wide variety of ways, and which also provides the user with greater novelty interest.

SUMMARY

Accordingly, embodiments of the present invention provide a make-up kit comprising a plurality of containers having top surfaces made up of different integer numbers of substantially identically shaped units and bottom surfaces made up of corresponding numbers of substantially identically shaped units, peripheral areas of the top surface units being of complementary shape to peripheral areas of the bottom surface units, so that each container is separably interengageable with at least one other of the containers above or below, by interengagement of the complementary shaped unit peripheral areas. In this way large or small numbers of identical or different units may be connected together in a large number of different configurations; each differently shaped container effectively forming a differently shaped, but mutually compatible, building block. The size of the assembled storage kit is therefore limited substantially only by the number of storage containers used, and its shape is limited only by the relative configurations in which each container may be assembled with others in the kit.

The complementary shapes may comprise for example a raised rim on one or other of the top or bottom surface units, and a recessed rim on the other one of the top or bottom surface unit.

The different container top and bottom surfaces in the kit may be made up of two or more of: one unit, two or more units side by side or four or more units in a rectangular array.

The storage containers may be open topped, e.g. to form a tray for reception of a godet, direct reception of solid or pasty cosmetic substances, or an "empty" tray for storage of loose items. The central portion(s) of the top surface units may be recessed to form the tray; the peripheries of the top surface units forming the top edge of the tray walls.

Additionally or alternatively, the storage containers may comprise openable drawers.

Additionally or alternatively, the storage containers may comprise openable lids, either separable from a base part of the container or hingedly or otherwise attached thereto.

The above and other preferred features of the invention are further described below with reference to illustrative embodiments shown in the drawings.

DETAILED DESCRIPTION

Figure 1A:
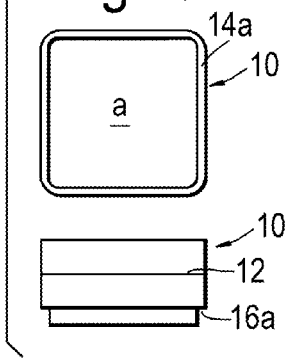
FIG. 1*a* shows a top plan view and side view of a first container, more specifically a storage tray forming a component of a kit embodying the invention.

The storage tray 10 shown in FIG. 1*a* is generally square in plan, with rounded corners. It is formed for example as a two part plastics injection moulding, with the parts joined along a circumferential line 12 to provide a high quality finish inside and out. The top surface of the tray is formed by an upstanding peripheral rim 14*a*, defining an upwardly open, central recess a. The bottom surface of the tray 10 comprises an indented peripheral rim or area 16*a* of complementary shape to the rim 14*a*. The outside dimension of the central part of the bottom surface is slightly undersized compared to the inside dimension of the recess a within the rim 14*a*, so that the base of an upper tray 10 is a close sliding fit or easy push fit within the rim of a lower tray 10. Two such trays may thus be assembled together, fixed one upon the other. The rim 14*a* and recess a together form a top surface unit 15*a* which is compatible with substantially identically shaped top surface units also found in other, differently sized and shaped, trays making up the kit. The peripheral indented rim and the central area of the tray base which it encloses, similarly form a bottom surface unit 17*a* of a shape substantially as found in and compatible with those other trays.

Figure 1B:
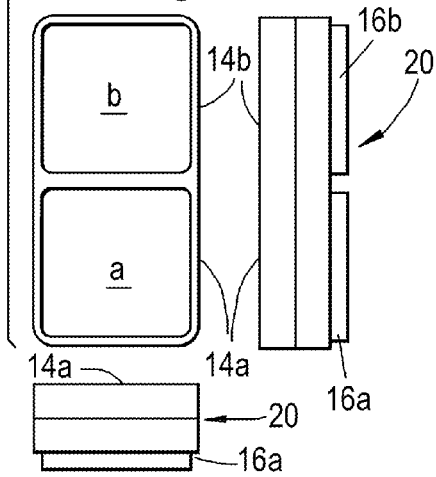
FIG. 1*b* shows a top plan view, front view and side view of a second similar storage tray for use together with the tray of FIG. 1*a*, to form another component of the kit.
Figure 2A:
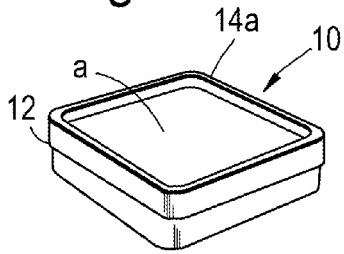
FIGS. 2*a* and 2*b* are perspective views of the trays of FIGS. 1*a* and 1*b* respectively.
Figure 2C:
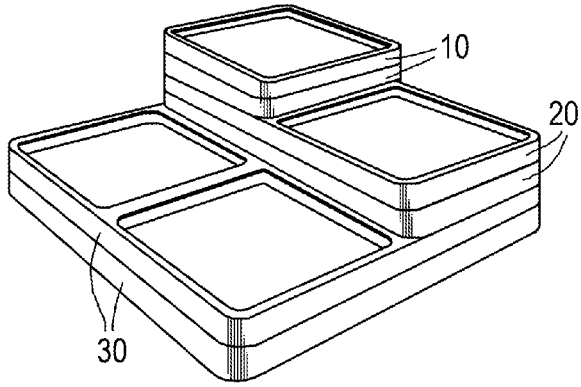
FIG. 2*c* is a perspective view showing one arrangement in which the trays of the preceding Figures may be stacked together or assembled to form a make-up kit.
Figure 2B:
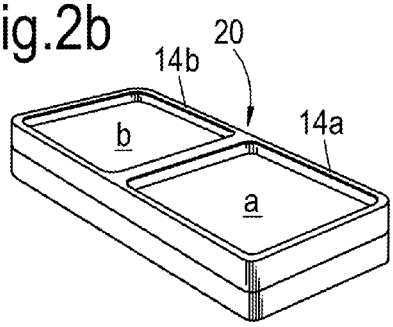

Thus larger tray 20 of FIGS. 1*b* and 2*b* is also made as a two part injection moulding but has two substantially identical rim portions 14*a* and 14*b* positioned side by side, each substantially identically shaped, and substantially identical in shape to the rim 14*a* of the smaller tray 10. The rim portions 14*a*, 14*b* of the tray 20 define respective recesses a, b which are substantially identical to each other and to the recess a in the smaller tray 10. The various recesses in the different trays may accommodate, for example, different shades of eyeliner or other compressed powder or pasty cosmetics. Alternatively, they can be left empty, for orderly storage of loose items. The base of the tray 20 similarly has indented rim portions 16*a*, 16*b* which are of substantially identical size and shape to each other and to peripheral base indent 16*a* of tray 10.

Figure 1C:
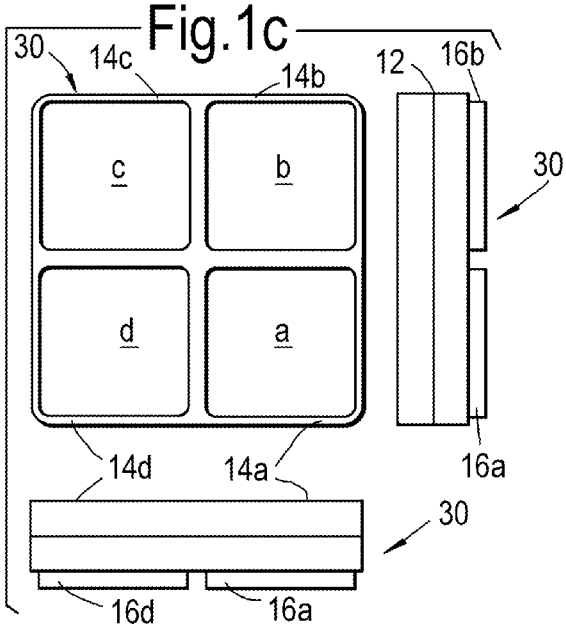
FIG. 1*c* shows top plan, side and front views of a third storage tray for use together with the storage trays of FIGS. 1*a* and/or 1*b* to form another component of the kit.

The still larger tray 30 of FIG. 1*c* continues the pattern described above for the trays 10, 20, being otherwise identical to these, but provided with four upwardly open recesses a, b, c, d, defined by four rim portions 14*a*, 14*b*, 14*c*, 14*d* respectively. The base of tray 30 comprises four indented rim portions 16*a*, 16*b*, 16*c*, 16*d* complementary to the rim portions 14*a-d*. The rim portions 14*a-d* of tray 30 are likewise substantially identical to and compatible with the rim portion 14*a* of tray 10; the indented rim portions 16*a-d* of tray 30 also being substantially identical to and compatible with the indented rim portion 16*a* of tray 10. Thus tray 10 has a single base surface unit 17*a* and a single top surface unit 15*a*; tray 20 has two such base surface units 17*a*, 17*b* side by side and two such top surface units 15*a*, 15*b* side by side; and tray 30 has a 2×2 array of such base surface units 17*a*, 17*b*, 17*c*, 17*d* and a similar array of such top surface units 15*a*, 15*b*, 15*c*, 15*d*. It will be seen that other sizes of compatible trays can be produced, having m x n arrays of base and top units, where m and n are integers greater than zero.

FIG. 2*c* shows a tray 20 with its base indented rim portions 16*a*, 16*b* engaged in the rim portions 14*a*, 14*b* of a tray 30, and a tray 10 with its base indented rim portion 16*a* engaged in the rim portion 14*b* of the tray 20. This leaves recesses c, d of tray 30 exposed for access, as well as the recesses a of trays 10 and 20. If access to the currently obscured recesses is required, trays can be removed or reconfigured to engage over other recesses until the desired recesses are exposed.

Figure 3:
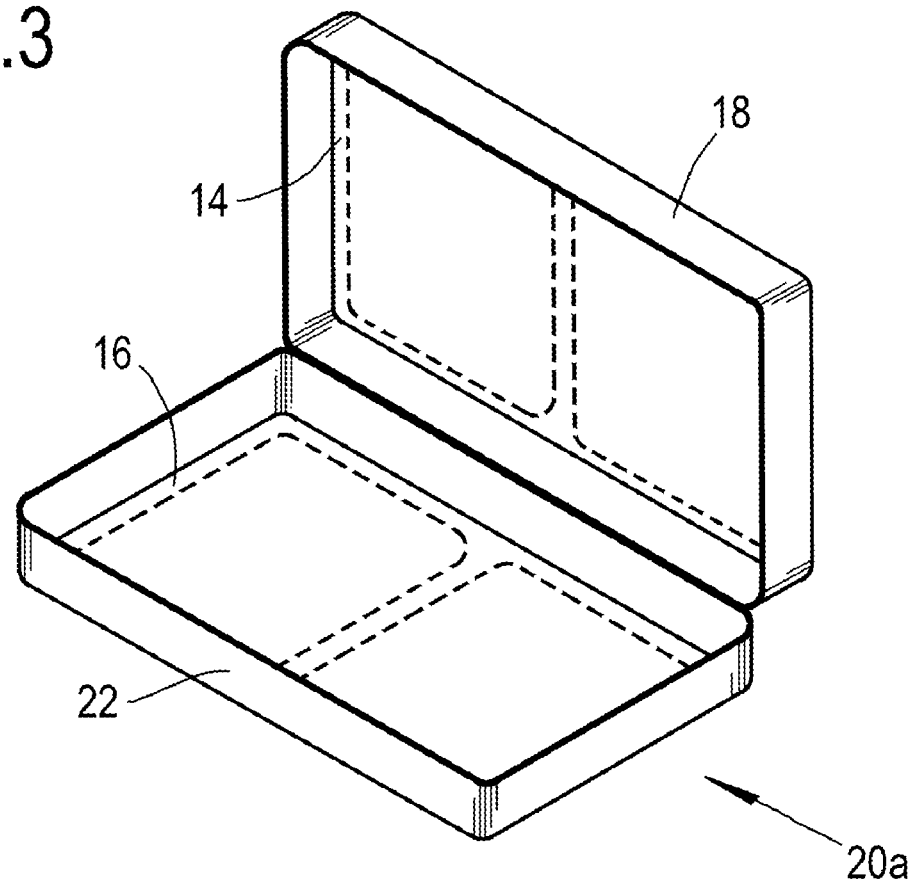
FIG. 3 is a perspective view of a container with an openable lid, which may be used together with or instead of the tray of FIGS. 1*b* and 2*b* in the kit.

FIG. 3 shows a modified storage unit based on the tray of FIGS. 1*b* and 2*b*. The storage unit 20*a* comprises a lid 18 connected to a base part 22 by any suitable hinge mechanism. The projecting rim portions 14 on the top of the lid are schematically indicated in dotted lines. The complementary indented rim portions 16 at the bottom of the base part 22 are indicated likewise. Alternatively, the rim portions 14 may be provided on the bottom of the base part and the indented rim portions at the top of the lid. Other container shapes may be provided with other numbers and configurations of top and bottom surface units, e.g. corresponding to, but not limited to those of the trays 10, 20, 30. The lid 18 may be otherwise connected to the base 22, e.g. to slide open, or open by rotation about a vertical axis; or the lid may be opened by removal (complete separation) from the base.

Figure 4:
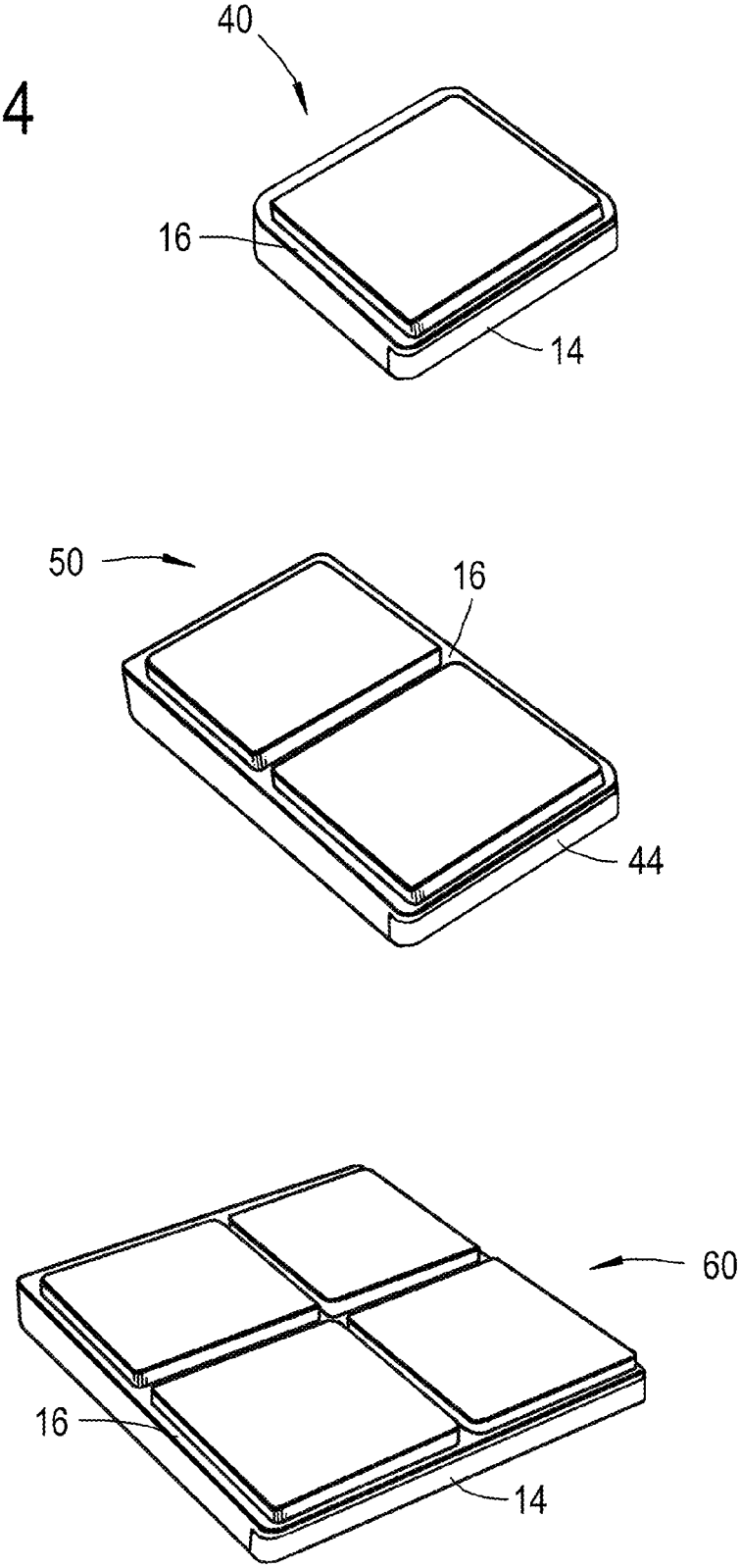
FIG. 4 shows perspective views of three differently sized storage containers having openable drawers and which may be used in the kit instead of or as well as the trays or container of the preceding Figures; the three containers being shown with their drawers shut.

FIG. 4 shows drawer-type storage containers for use in a kit embodying the invention; in particular a 1 unit storage container 40, a 2×1 unit storage container 50 and a 2×2 unit storage container 60. Here the projecting rims 14 are provided on the bottom of each container and the complementary indented rim portions 16 at the top.

Figure 5:
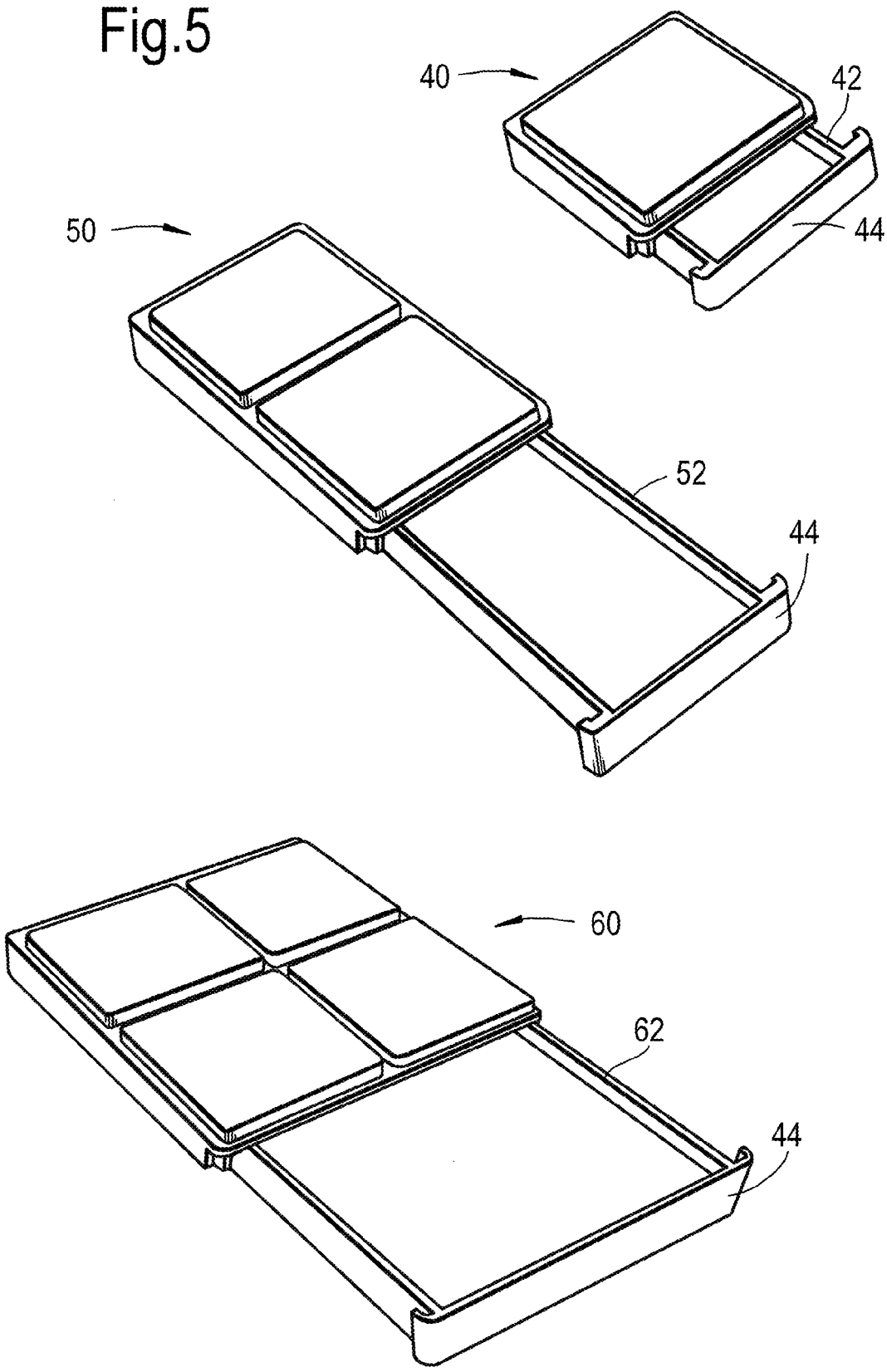
FIG. 5 corresponds to FIG. 4, but shows the drawers open.

FIG. 5 shows the storage units with their respective drawers 42, 52, 62 open. Drawer 62 is about twice as big as drawer 52 and may contain, for example, face powder. Drawer 52 is about twice as big as drawer 42 and may contain, for example, blusher. Drawer 42 may contain eye shadow, for example. The ends of the drawer fronts are curved as shown at 44, to blend with the drawer housings when closed, and form curved corners matching those at the rear of the drawer housing.

Figure 6:
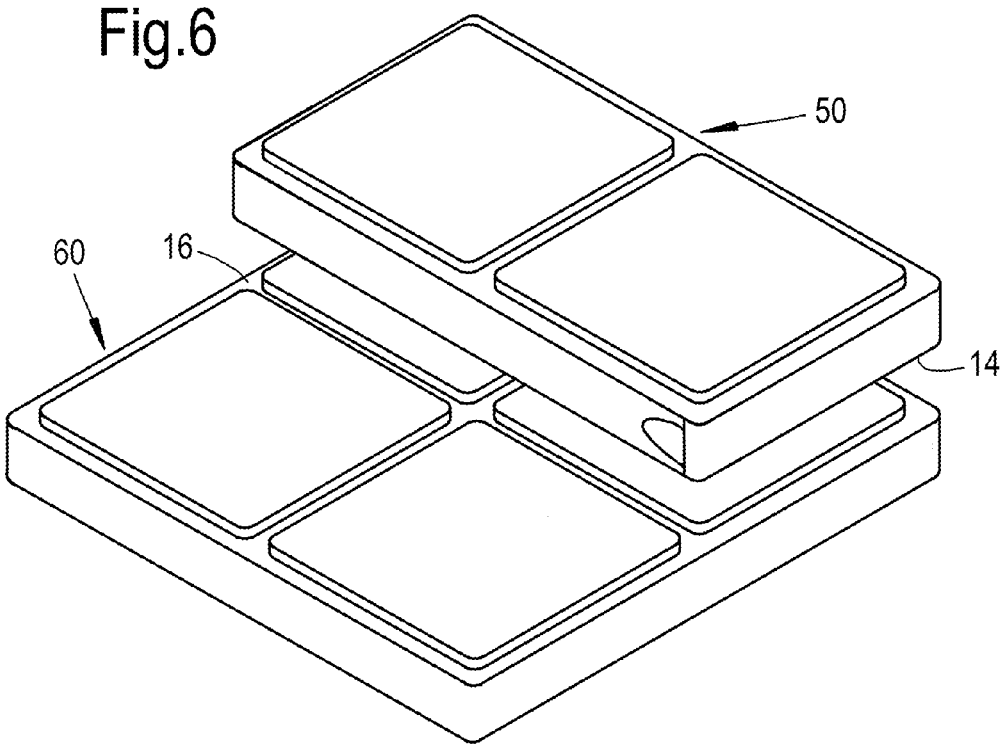
FIG. 6 shows two of the containers in FIG. 4 being assembled.
Figure 7:
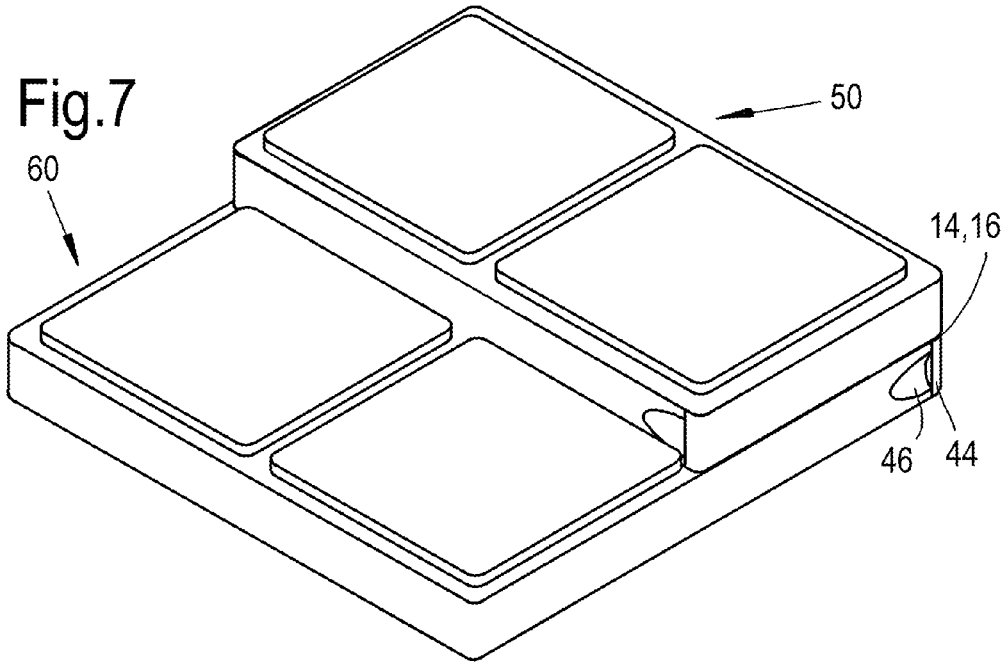
FIG. 7 shows the resulting assembly.
Figure 8:
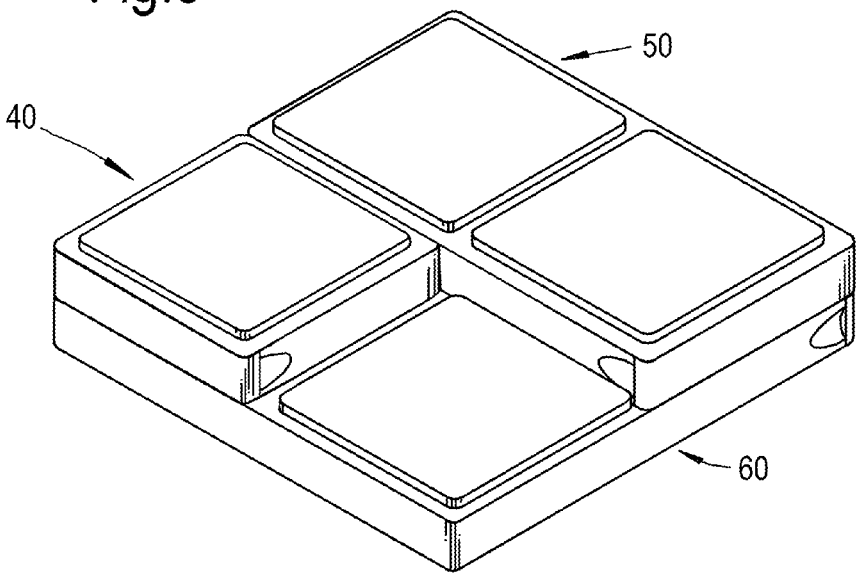
FIG. 8 shows all three of the containers of FIG. 4 assembled.
Figure 9:
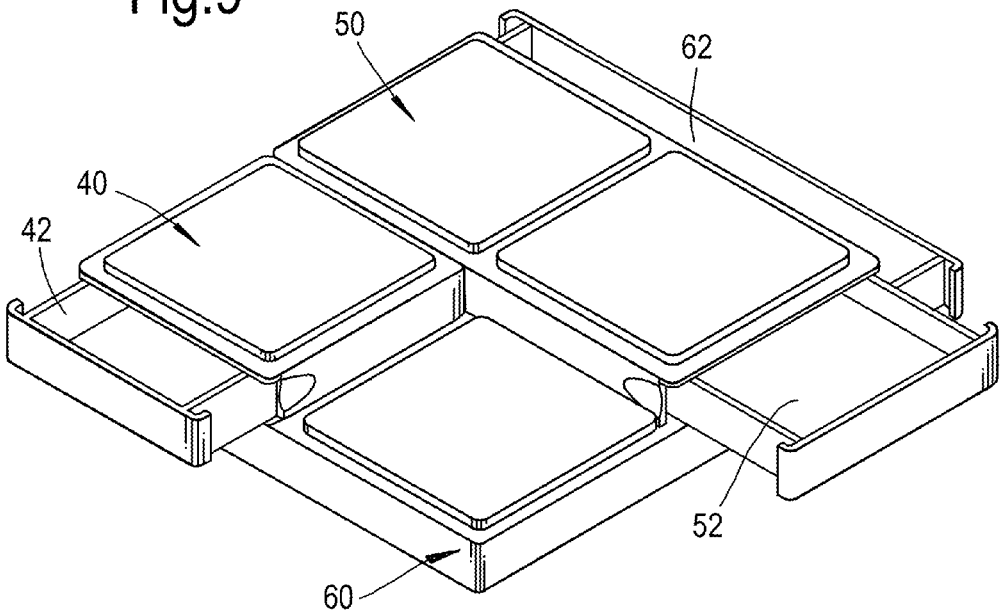
FIG. 9 shows the assembly of FIG. 8 with the drawers open.

FIG. 6 shows the container 50 being offered up for engagement with the container 60, with the protruding rim 14 on the bottom of container 50 directly above and in alignment with the right-hand half of the indented rim portion 16 at the top of the container 60. FIG. 7 shows the two containers 50, 60 in assembled engagement, with the rim 14 received in a corresponding part of the indented rim 16. FIG. 7 also shows a relieved area 46 on the drawer housing of container 60 immediately behind the end 44 of the drawer front when in its closed position, so that the drawer front may be more readily gripped for opening. FIG. 8 shows a storage container 40 added to the assembly, and FIG. 9 shows all three of the assembled containers with their drawers open.

Figure 10:
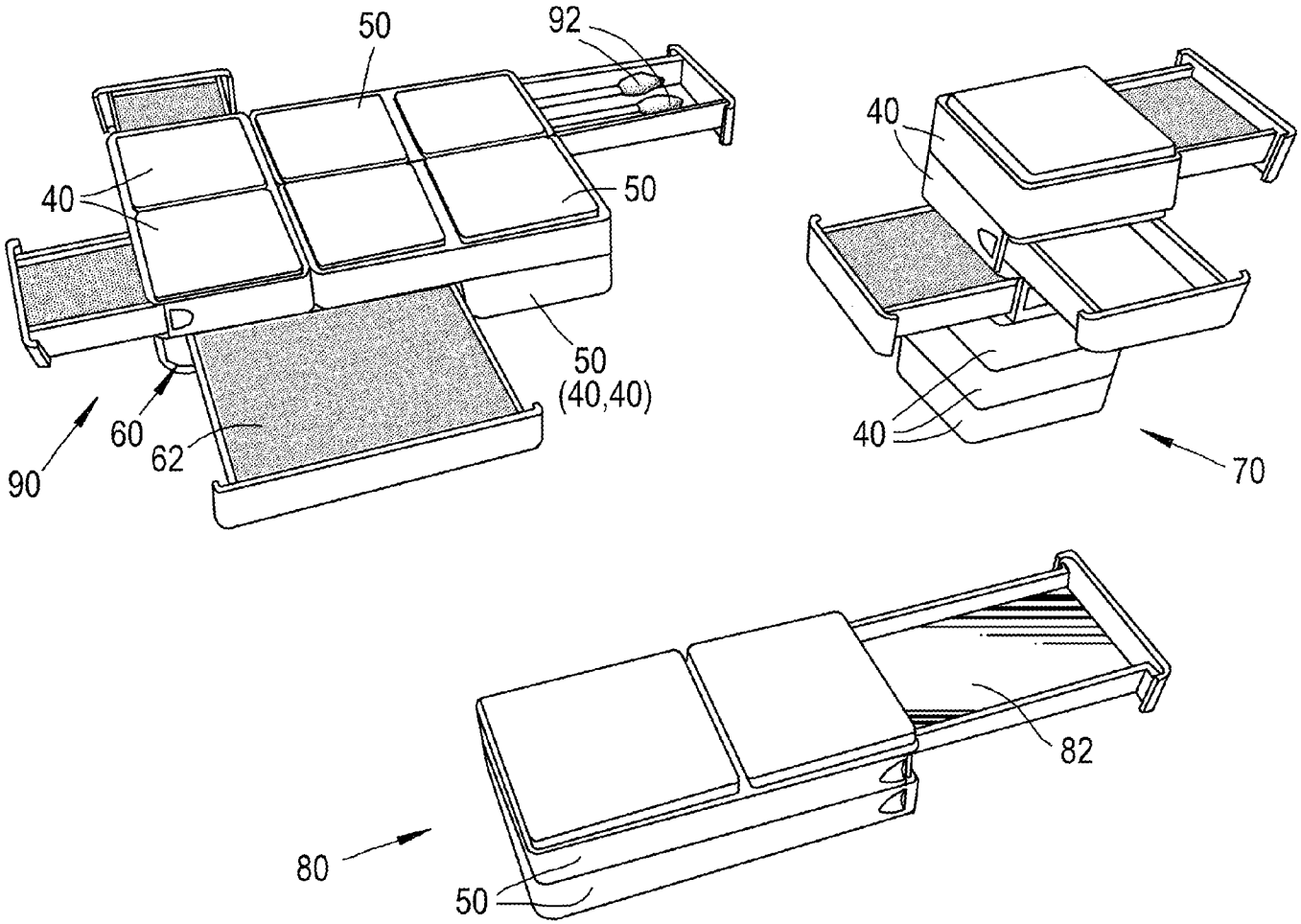
FIG. 10 shows various possible assemblies comprising different combinations of the containers of FIG. 4, some with open drawers, and others not.

FIG. 10 shows various different assemblies of drawer-type storage containers as illustrated in FIGS. 4-9. Assembly 70 consists of a vertical stack of six containers 40, the top three of which are shown arranged with their drawers opening in different directions. Clearly however, each container can be engaged with a neighbouring container in four different relative orientations about the vertical axis, including one in which their drawer opening directions are aligned. Assembly 80 consists of a stack of two containers 50, the top drawer of which is open to reveal a mirror 82. Assembly 90 has a bottom layer consisting of a container 60 whose drawer 62 is shown open, and a container 50 (or two containers 40) to the right of the container 60 as shown. Assembly 90 also has a top layer consisting of two containers 50, one in front of the other at the right hand side, and two containers 40, one in front of the other at the left hand side. The drawer of the rear container 50 is open to reveal two make up applicators 92. The three further drawers shown open in this assembly contain compressed powder cosmetics.

Numerous modifications will be readily apparent within the scope of the claims. For example the various features of the tray-type, lidded and drawer-type containers can be used in other combinations not illustrated. Although generally square shaped top and base units have been shown and described, other tessellatable base unit shapes (e.g. rectangular, triangular, hexagonal) can equally be used, either alone or in combination with others. The containers can be assembled and used together in a theoretically limitless number of combinations and configurations. A customer is therefore free to acquire and use any number and type of the kit components, and to use them in a multitude of different combinations and configurations, to customise her own make up kit and personal item storage unit/organiser.

What is claimed is:

1. A vertically stackable make-up kit, comprising:

a plurality of containers arranged in a stacked configuration where the containers are interchangeable and form a make-up kit having multiple tiers where each tier comprises one or more containers, each container having sidewalls, at least one upper rim, and at least one lower protrusion extending from a bottom portion of the container, wherein the lower protrusion of one container has a shape which corresponds to the shape of the upper rim of another container allowing each lower protrusion to mate with a corresponding upper rim to form the stacked configuration, wherein a recess receiving a cosmetic material extends from each upper rim toward each lower protrusion such that the number of upper rims, lower protrusions and recesses is equal in each container, wherein a first container in the system has a fewer number of upper rims, lower protrusions and recesses than a second container in the system.

2. The make-up kit of claim 1, wherein the first container comprises a single upper rim and a single lower protrusion, and wherein the second container comprises multiple upper rims and multiple lower protrusion, such that first container engages the second container.

3. The make-up kit of claim 1, wherein the first container comprises two upper rims and two lower protrusions, and wherein the second container comprises four upper rims and four lower protrusions, such that first container engages the second container.

4. The make-up kit of claim 1, wherein the second container forms a base tier of the make-up kit and wherein one or more first containers are positioned upon the second container.

5. The make-up kit of claim 1, further comprising a lid, wherein the lid is separable from a base part of the container or slideable relative to the base part of the container or hingedly attached thereto.

6. The make-up kit of claim 1, further comprising at least one additional container that comprises a drawer.

7. A vertically stackable make-up kit, comprising:

a plurality of vertically stackable containers, each of the containers in the make-up kit comprising sidewalls where one of the sidewalls forms a front grasping portion of a slideably openable drawer wherein cosmetic materials are stored, a top surface comprising one or more projections having indented rims and a bottom surface comprising one or more recesses which are complementary to the projections so as to permit a bottom surface of one or more of the containers in the make-up kit to be interchangeably vertically stacked upon a top surface of another container in the make-up kit;

wherein the number of projections and recesses in an individual container is equal and the number of projections and recesses of different containers in the make-up kit is made up of different numbers of projections and complementary recesses.

8. The make-up kit of claim 7, wherein the top and bottom surfaces in the make-up kit comprise a container with a single projection and a single complementary recess, a container with two projections and two recesses, or a container with four projections and four recesses.

9. The make-up kit of claim 7, further comprising at least one additional container that comprises an openable lid, the openable lid being separable from a base part of the container or slideable relative to the base part of the container or hingedly attached thereto.

* * * * *